US006324046B1

(12) United States Patent
Kadah

(10) Patent No.: US 6,324,046 B1
(45) Date of Patent: Nov. 27, 2001

(54) ACTUATOR CIRCUIT FOR DUAL-SOLENOID GAS VALVE

(76) Inventor: Andrew S. Kadah, 5000 S. Hennaberry Rd., Manlius, NY (US) 13104

( * ) Notice: Subject to any disclaimer, the term of this patent is extended or adjusted under 35 U.S.C. 154(b) by 0 days.

(21) Appl. No.: 09/457,147

(22) Filed: Dec. 9, 1999

(51) Int. Cl.[7] ..... H01H 47/00; F23N 5/00
(52) U.S. Cl. ..... 361/166; 361/247; 361/168.1
(58) Field of Search ..... 361/166, 168.1, 361/191, 154, 247, 156, 253

(56) References Cited

U.S. PATENT DOCUMENTS 5,085,574 * 2/1992 Wilson et al. ..... 431/6
5,889,645 * 3/1999 Kadah et al. ..... 361/191
5,917,691 * 7/1999 Kadah ..... 361/154
6,154,380 * 11/2000 Assow et al. ..... 363/61
6,198,644 * 3/2001 Minimisawa ..... 363/44

* cited by examiner

*Primary Examiner*—Kim Huynh
(74) *Attorney, Agent, or Firm*—Bernhard P. Molldrem, Jr.

(57) ABSTRACT

An arrangement for driving a pair of actuator solenoids or coils of a gas valve having two or more solenoids employs a microprocessor or similar controller and an driver circuit. An output terminal of the microprocessor provides a steady low for OFF and a pulsating output signal for ON. A transistor switching device is gated by the microprocessor, drives the first solenoid as its collector load. A rectifying diode connects the first solenoid to an accumulator capacitor, which ramps up from flyback pulses that pass through the rectifier. A negative resistance discharge device conducts when the accumulated voltage exceeds a threshold to energize the second solenoid. In a favorable embodiment the impedance of the second solenoid is higher than the first solenoid. In a second embodiment, the actuator circuit for the second solenoid can be a voltage doubling flyback driven relaxation oscillator.

10 Claims, 2 Drawing Sheets

ACTUATOR CIRCUIT FOR DUAL-SOLENOID GAS VALVE

BACKGROUND OF THE INVENTION

The present invention relates to control and actuator circuits for furnaces or similar gas burning equipment. The invention is more specifically concerned with a driver circuit for a gas valve will actuate a dual-solenoid gas valve in a fashion that will fail-safe when one component of the gas valve fails or sticks. The invention is also concerned with a circuit that actuates two or more solenoids from a single controller output.

In a modern gas furnace, one or more gas burners inject a gas flame through a heat exchanger, and the combustion gases are drawn through the heat exchanger by means of an inducer blower, which exhausts the combustion gases to a vent or flue. A pressure sensor associated with the inducer actuates a pressure switch to indicate a pressure differential between the exhaust and intake of the inducer. The pressure switch provides assurance that the inducer is functioning properly. There is also a flame sensor which is intended as a means for shutting the gas valve off if flame does not appear in the burner after some limited period of time.

An indoor air blower forces air from a comfort zone past the heat exchanger to draw heat from the combustion gases. The warmed air is then returned to the comfort zone. A temperature limit switch on the heat exchanger is normally closed, and opens if the heat exchanger exceeds a predetermined temperature. This limit switch serves as a check on proper air flow and functioning of the indoor air blower.

A thermostat located in the comfort zone closes when the room temperature drops below a predetermined setpoint, and thereby signals a call for heat. When a call for heat is detected, control and timing circuitry for the furnace actuates the inducer blower and then initiates an actuation sequence which energizes a gas valve relay so that current is supplied to the gas valve. This allows combustion gas to flow to the burners. At this time, igniters are actuated to light the burners, and the furnace begins to produce heat. An infrared detector, rectification or other mechanism is employed to ensure that there is flame after the gas valve is actuated. If no flame is present, another series switch interrupts the thermostat power and turns off the gas valve. Also, a rollback switch detects if flame is not entering the heat exchanger but is instead proceeding in the combustion air intake direction.

After the burners have been ignited for a predetermined time, the room air blower is powered up, and this creates a flow of warm air to the interior comfort zone.

Conventionally, 24 volt thermostat power, either AC or DC, is supplied through the series arrangement of the limit switch, thermostat, pressure switch, gas valve relay, and gas valve.

As aforementioned, the limit switch, thermostat, and pressure switch are all disposed in series with the gas valve relay, so that no current can flow through the gas valve relay to actuate the gas valve, until the limit switch and pressure switch are both closed. This serves as a check that the room air blower and the inducer blower are functioning properly.

A safety problem can arise if any of the limit switch, pressure switch, or gas valve relay are for some reason locked into a closed condition. In those cases, the gas valve will continue to feed gas to the burners if the heat exchanger experiences overtemperature, or if the inducer fails to produce sufficient draft.

This problem, and a solution to it, are described in Kadah U.S. Pat. No. 5,917,691 and in Kadah et al. U.S. Pat. No. 5,889,645.

Generally, whenever there is a call for heat, the controller should be able to check the conditions of the pressure switch and the gas valve relay before supplying current to the coil for the gas valve relay. This permits the control circuit to check for switch malfunction and indicate a service condition, if service or repair is required.

The gas valve relay has a pair of actuator coils, and these are generally connected in parallel. A gas valve driver circuit is controlled by an output of the microprocessor and supplies drive current to both coils. Each solenoid has an associated gas valve mechanism, and these are connected in series on the gas line so that both valve mechanisms have to open for gas to reach the burner. This is intended as a safety measure, and to ensure that one of the gas valves will close if, for some reason, the other sticks in the open position. Also, the gas valve relay driver circuit is typically designed so that if any of the driver components fail, the gas valve will not turn on. These safety features are necessary to keep the room space around the furnace from flooding with unignited gas, as that could present a danger of either suffocation or explosion. Normally, the two solenoids are tied together, so that the driver feeds both of them at the same time. However, an additional safety feature can be obtained by driving one of the two solenoids directly, and the other indirectly. In that way, if the first solenoid or its driver fuses or is locked up, the second solenoid will fail to actuate, i.e., will not turn on its associated gas valve mechanism. Unfortunately, no one has previously configured a gas valve driver to do this.

OBJECTS AND SUMMARY OF THE INVENTION

It is an object of this invention to provide a fail-safe drive system for a gas valve or other device which will takes advantage of the dual-solenoid construction of the gas valve and avoids the drawbacks of the prior art.

It is another object to provide a dual-solenoid drive circuit that is actuated from a single output of a microprocessor or other controller circuit.

It is a further object of the invention to utilize flyback voltage from the actuation of the first solenoid for energizing the second and further solenoids.

According to an aspect of this invention, an actuator circuit is configured for electrically actuating a dual-solenoid gas valve, of the type in which a first solenoid and a second solenoid are both energized to open the gas valve to supply a gas burner for a furnace or other gas-powered appliance. In the actuator circuit of this invention, a controller circuit selectively provides output pulses at an output terminal. These output pulses can have a first state at which pulses are present (i.e., pulsating) and a second state in which pulses are absent (i.e., steady high or steady low). A transistor or other switch device has its base, gate or similar control electrode coupled to the output terminal of said controller circuit, and has its collector, drain, or similar output electrode connected to the first solenoid to supply drive pulses to it. A flyback-driven relaxation oscillator circuit has an input coupled to the junction of the first solenoid and the output electrode (e.g., collector) of the switch transistor, so as to receive flyback voltage from the first solenoid. An output of the oscillator circuit is connected to second solenoid and provides drive pulses to the second solenoid. In a preferred arrangement, the flyback-driven relaxation oscillator circuit is formed of a diode or similar rectifier having one electrode coupled to the junction of said first solenoid and said switch transistor, and an accumulator capacitor connected to a second electrode of said rectifier to accumulate said flyback voltage. A negative resistance device or similar discharge device is connected between the accumulator capacitor and the second solenoid to discharge energy from said capacitor into said second solenoid when the accumulated flyback voltage has risen to some threshold. The controller arrangement typically may be a microprocessor device, but the arrangement could be based on a multivibrator circuit, a PUT based circuit, or a logic circuit used in place of the microprocessor.

The relaxation oscillator circuit may be configured as a voltage doubler arrangement, with a voltage doubler connected between the above-mentioned junction and the second solenoid. In that case, the flyback-driven relaxation oscillator circuit is formed with a capacitor and diode connected between the junction and a reference voltage point, e.g., ground, and with one end of the second solenoid connected to the discharge device and a second end connected to a junction of the capacitor and the diode. A second diode may be connected in anti-parallel with the first-mentioned diode and capacitor between the above-mentioned junction and the reference voltage point. This configuration is especially useful with dual solenoid gas valves in which the second solenoid is of a higher impedance than the first solenoid.

In the actuator circuits according to this invention, in the case that the switching transistor fuses ON or OFF, flyback pulses will not occur and the second solenoid will not actuate. This precludes the unsafe situation in which drive circuit failure would maintain an ON condition for a standard configuration where the same drive circuit powers both solenoids directly.

The above and many other objects, features, and advantages of this invention will present themselves to persons skilled in the art from the ensuing detailed description of a preferred embodiment of the invention, when read in conjunction with the accompanying Drawing.

DETAILED DESCRIPTION OF THE PREFERRED EMBODIMENTS

Figure 1:
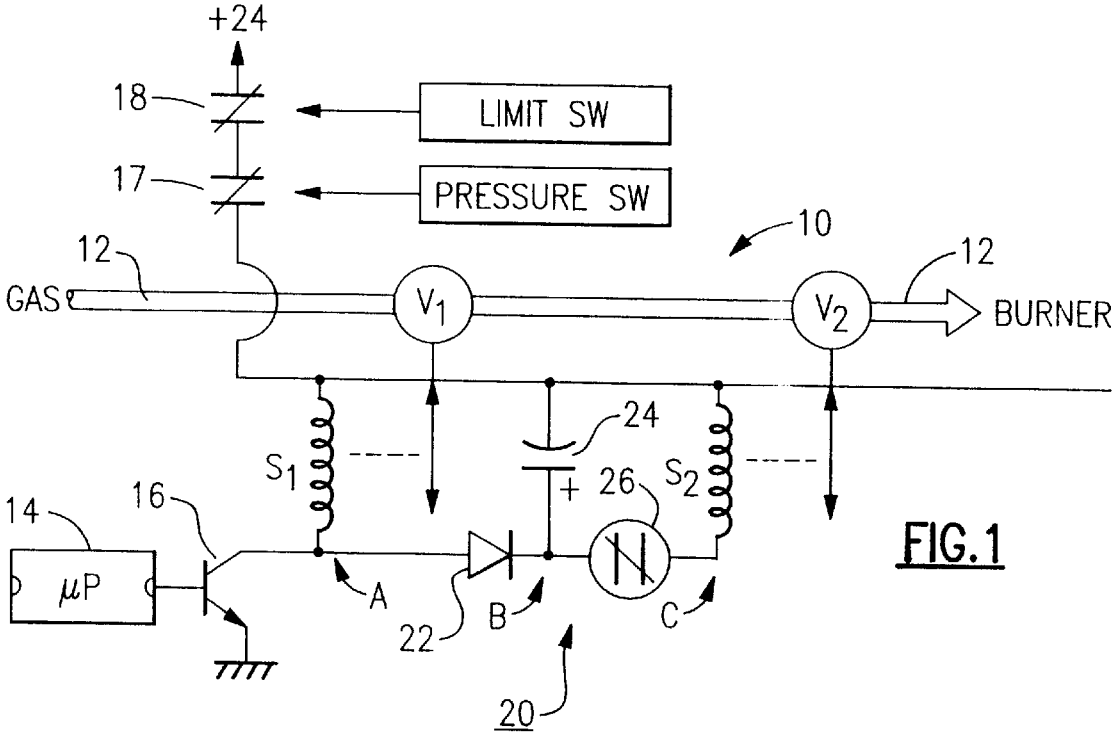
FIG. 1 is a schematic diagram of a microprocessor-based drive circuit for a dual-solenoid gas valve, according to an embodiment of this invention.

With reference to the Drawing, FIG. 1 schematically illustrates a gas valve 10 for a gas furnace or similar equipment. The gas valve 10 has first and second valve elements $V_1$ and $V_2$ placed in tandem on a gas line 12 in advance of a gas burner, and has first and second solenoids $S_1$ and $S_2$ that must both be energized to open the valve elements $V_1$, $V_2$ for gas to flow and combustion to take place. This is a protective feature, and ensures that the gas flow will shut off in the event that one of the two valve elements sticks or locks up in the open position. The solenoids are actuated from an output terminal of a control microprocessor 14. The microprocessor 14 also has power leads connected to suitable voltage points, e.g., +5 volts and ground, and various inputs, such as a thermostat input. The output terminal of the microprocessor is coupled to the base of a switching or drive transistor 16. While not shown, there may be a gate capacitor and biasing elements between the base of transistor 16 and the output of the microprocessor. In this embodiment, the microprocessor output has a pulsating state that corresponds to ON, and a steady state, i.e., a steady low, to correspond to OFF. Here, the emitter of the transistor 16 connects to ground or another point of reference voltage, while the collector connects to a free end of the solenoid $S_1$. The other end of solenoid $S_1$ is connected in a series circuit of a pressure switch 17 and a limit switch 18 to a voltage source, i.e., +24 volts. The switches 17 and 18 represent some of the various elements described above. While this embodiment uses a DC supply, it is possible that standard 24 volt AC voltage could be supplied through the switches 17 and 18, in which case a suitable full-wave rectifier may be interposed between the latter and the solenoids of the gas valve. Also, the transistor 16 is not limited to the NPN transistor as illustrated here, but may be an FET or any other suitable switching transistor or other device, as known in the art.

In this embodiment, an actuator circuit 20 for energizing the second solenoid $S_2$ is configured as a flyback-driven relaxation oscillator. A rectifier diode 22 has its anode connected to the junction of the first solenoid $S_1$ and the collector of the transistor 16, and has its cathode connected to the positive side of an accumulator capacitor 24. The capacitor has its negative side connected to the supply side of the first solenoid $S_1$ to which is tied also the second solenoid $S_2$.

A discharge switch element 26 connects between the positive side of the capacitor 24 and the other side of the solenoid $S_2$. The discharge switch element closes to discharge the energy stored on the capacitor 24 when the flyback voltage stored on it exceeds some predetermined threshold. An example of the element 26 may be an SCR in combination with a zener, where the zener is tied between anode and gate of the SCR, with the anode tied to the capacitor 24 and the cathode of the SCR connected to the solenoid $S_2$. Such device would turn ON when the accumulated flyback voltage exceeds the zener voltage. An implementation of this is described in U.S. Pat. No. 6,222,719. Other suitable negative resistance devices could be used instead, or a neon could serve this function.

Figure 2:
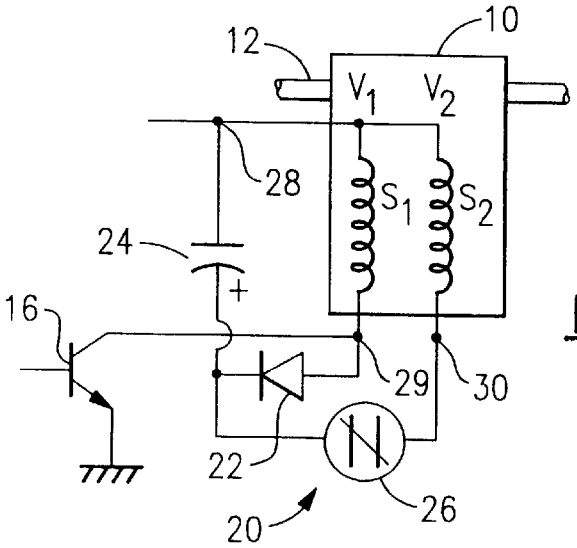
FIG. 2 is a schematic diagram of a practical application of this embodiment.

As shown in FIG. 2, the arrangement of this invention can be installed as an after-market modification on an existing gas valve by connecting to three circuit points. More specifically, one side of the capacitor 24 is tied to a lead 28 that connects to the supply side of the solenoids $S_1$, $S_2$, the junction point between the rectifier diode 22 and the transistor 16 is tied to a lead 29 at the low side of the first solenoid $S_1$, and the discharge switch element 26 is tied to a lead 30 at the low side of the second solenoid $S_2$.

It should be apparent that this embodiment permits the usual gas valve relay to be dispensed with, as the gas valve 10 is controlled directly from the microprocessor 14. This eliminates that relay as a potential source of trouble and failure in furnace design.

Figure 3:
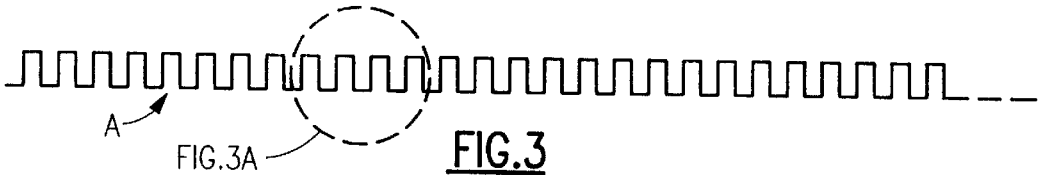
FIGS. 3, 4, and 5 are wave charts for explaining the operation of this embodiment.
Figure 3A:
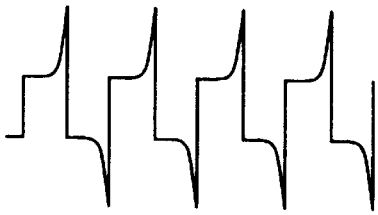
FIG. 3A is an enlargement of a portion of FIG. 3.
Figure 4:
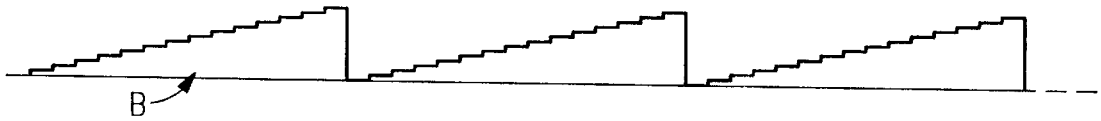
Figure 5:
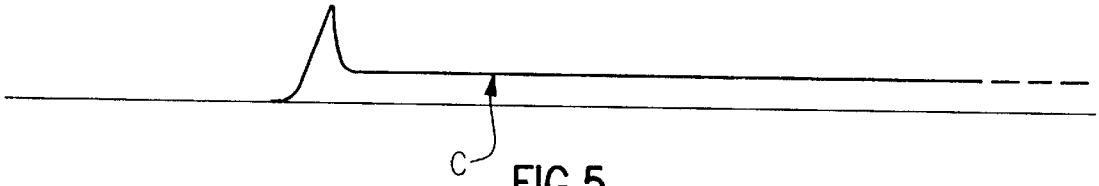

The operation of the above embodiment can be explained briefly with reference to the waveforms shown in FIGS. 3, 4, and 5. When there is a call for heat, the output of the microprocessor generates a pulsating signal, which may be a train of pulses at 1 KHz, 50% duty cycle, and this causes the transistor 16 to conduct and shut off at this rate, alternately commencing and interrupting the current through the solenoid S1. This generates a voltage waveform A as shown in FIG. 3. The inductance of the solenoid S1 generates flyback pulses at the current transitions, as shown in the enlarged view of waveform A in FIG. 3A. The positive flyback voltage passes through the rectifying diode 22, and the voltage B at the capacitor 24 gradually ramps up as shown at FIG. 4, until the threshold level of the element 26 is exceeded. At that time, the charge stored on the capacitor 24 is dumped through the element 26 into the second solenoid $S_2$, creating a dc level C shown in FIG. 5. Alternatively, this can be pulses having a frequency, e.g., on the order of 100 Hz.

In the gas valve actuator circuit of this invention, a failure mode in which the transistor 16 is fused into a conductive state, results in the second solenoid $S_2$ not receiving any current. In that mode, a direct current flows through the first solenoid $S_1$, and there are no flyback pulses to supply the actuation circuit 20. The capacitor 24 will not charge and the discharge element 26 will not fire. The microprocessor 14 can detect the condition of the transistor 16 and cause a service indicator lamp to light to indicate that repair is needed.

Figure 6:
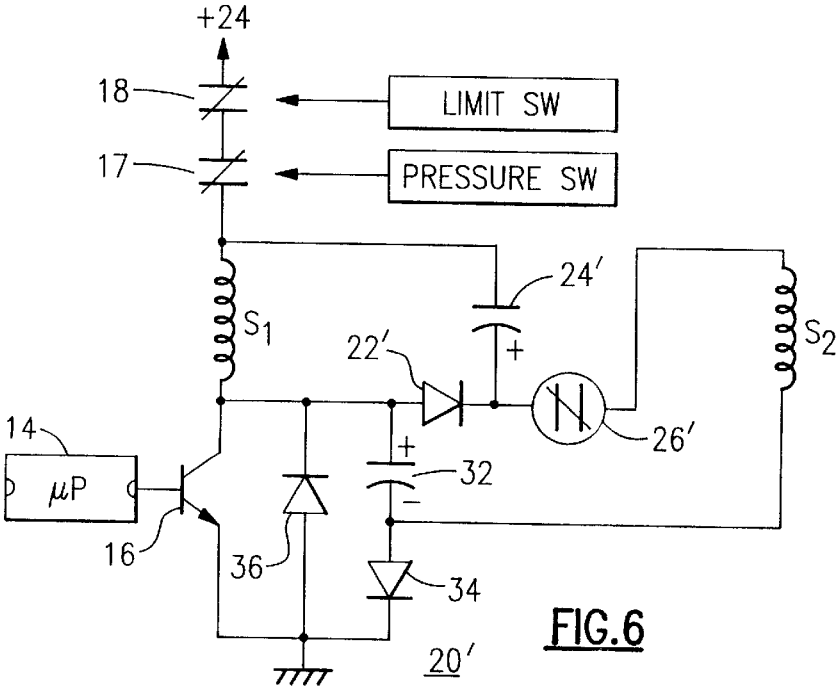
FIG. 6 is a schematic circuit diagram of another embodiment of the invention.

A second embodiment of this invention is shown schematically in FIG. 6. Elements that are the same as those in the FIG. 1 embodiment are identified with the same reference numbers, and those which are modified are identified with a primed reference number. This embodiment is similar in most ways to the FIG. 1 embodiment, except that the actuator circuit 20' for supplying the second solenoid $S_2$ is configured as a voltage doubling relaxation oscillator. Here a flyback rectifier diode 22' has its anode connected to the first solenoid $S_1$ and to the collector of the transistor 16, and has its cathode connected to the positive side of accumulator capacitor 24'. As in the first embodiment, a discharge device 26' connects between the accumulator capacitor 24' and one end of the second solenoid $S_2$. In advance of the flyback rectifier diode 22' there is a series circuit formed of a capacitor 32 and a diode 34, with the cathode of the diode 34 tied to ground, so that the series circuit 32, 34 is in parallel or shunt with the collector-emitter path of the transistor 16, that is, between the junction of transistor 16 and solenoid $S_1$, on one end, and the voltage reference point or ground on the other. Another diode 36 is situated in anti-parallel with the capacitor 32 and diode 34, that is, with its anode connected to ground and its cathode to the junction of the transistor collector with the solenoid $S_1$.

In this embodiment, the supply side of the solenoid $S_1$ is not tied directly to the solenoid $S_2$, but instead the solenoid $S_2$ connects between the discharge device 26' and the junction of the capacitor 32 and the diode 34.

The FIG. 6 embodiment is advantageous when applied to dual-solenoid gas valves in which the second gas valve solenoid $S_2$ is of greater impedance than the first gas valve solenoid $S_1$.

This circuit may find appropriate applications outside of the gas furnace application as described here, where there are two or more solenoids that need to be actuated together.

While the invention has been described in detail with reference to selected preferred embodiments, is should be recognized that the invention is not limited to those precise embodiments. Rather, many modifications and variations would present themselves to persons skilled in the art without departing from the scope and spirit of this invention, as defined in the appended claims.

I claim:

1. Actuator circuit for electrically actuating a dual-solenoid gas valve on a gas line, in which a first gas-valve solenoid and a second gas-valve solenoid are both energized to open the gas valve to supply a burner; comprising:

a controller circuit for selectively providing output pulses at an output terminal having a first state at which pulses are present and a second state in which pulses are absent;

a switch device having a control electrode coupled to the output terminal of said controller circuit and an output electrode connected to said first gas-valve solenoid to supply drive pulses thereto to open a first valve element on said gas line; and a flyback-driven relaxation oscillator circuit having an input coupled to a junction of said first gas-valve solenoid and the output electrode of said switch device to receive flyback voltage from said first gas-valve solenoid, and an output connected to said second gas-valve solenoid to provide drive pulses thereto to open a second valve element in tandem with said first valve element on said gas line.

2. The actuator circuit according to claim 1 wherein said flyback-driven relaxation oscillator circuit includes a rectifier having one electrode coupled to said junction of said first gas-valve solenoid and said switch device; an accumulator capacitor connected to a second electrode of said rectifier to accumulate said flyback voltage; and a discharge device connected between said accumulator capacitor and said second gas-valve solenoid to discharge energy from said capacitor into said second gas-valve solenoid when the accumulated flyback voltage reaches a threshold.

3. The actuator circuit according to claim 2 wherein said relaxation oscillator circuit further includes a voltage doubler arrangement connected between said junction and said second gas-valve solenoid, said voltage doubler arrangement including a series circuit formed of a capacitor and a diode, said series circuit being connected in shunt across said switch device, and another diode in antiparallel with the series circuit of said capacitor and diode.

4. The actuator circuit according to claim 2 wherein said flyback-driven relaxation oscillator circuit includes a capacitor and diode connected between said junction and a reference voltage point, and wherein said second gas-valve solenoid has a first end connected to said discharge device and a second end connected to a junction of said capacitor and said diode.

5. The actuator circuit according to claim 4 further comprising a second diode in anti-parallel with the first-mentioned diode and capacitor between said junction and said reference voltage point.

6. The actuator circuit according to claim 1 wherein said controller circuit includes means for detecting the condition of the switch device, and means to cause a service indicator lamp to light when the controller circuit detects that the switch element is not responding to the output pulses provided from said controller circuit.

7. The actuator circuit according to claim 1 wherein said second gas-valve solenoid has an impedance that is greater than the impedance of said first gas-valve solenoid.

8. A combination of a dual-solenoid gas valve arrangement and an actuator circuit therefor, comprising:

a dual-solenoid gas valve arrangement in which a first solenoid and a second solenoid are both energized to open respectively a first gas valve element and a second gas valve that are connected in tandem on a gas line to supply fuel gas to a burner; and an actuator circuit for electrically actuating the first and second solenoids to open the first and second gas valves; the actuator circuit including a controller circuit for selectively providing output pulses at an output terminal having a first state at which pulses are present and a second state in which pulses are absent;

a switch device having a control electrode coupled to the output terminal of said controller circuit and an output electrode connected to said first solenoid to supply drive pulses thereto; and a flyback-driven relaxation oscillator circuit having an input coupled to a junction of said first solenoid and the output electrode of said switch device to receive fly-back voltage from said first solenoid, and an output connected to said second solenoid to provide drive pulses thereto.

9. The combination according to claim 8, wherein said second solenoid has a greater impedance than the impedance of said first solenoid.

10. The combination according to claim 8, wherein said switch device includes a transistor having a control electrode supplied by said controller circuit with said output pulses, and said controller circuit includes means for detecting the condition of the transistor, and means to cause a service indicator lamp to light when the controller circuit detects that the transistor is not responding to the output pulses provided from said controller circuit.

* * * * *